United States Patent [19]

Henmi

[11] Patent Number: 4,835,511

[45] Date of Patent: May 30, 1989

[54] QUASIFIXED VARIABLE RESISTOR

[75] Inventor: Shoichi Henmi, Miyagi, Japan

[73] Assignee: Alps Electric Co., Ltd., Japan

[21] Appl. No.: 89,742

[22] Filed: Aug. 26, 1987

[30] Foreign Application Priority Data

Nov. 11, 1986 [JP] Japan ..... 61-171921[U]

[51] Int. Cl.[4] ..... H01C 10/34

[52] U.S. Cl. ..... 338/174; 338/162; 338/169

[58] Field of Search ..... 338/162, 163, 169, 174, 338/175, 134, 135, 137, 184, 199

[56] References Cited

U.S. PATENT DOCUMENTS 4,110,722 8/1978 Brendle et al. ..... 338/164 X
4,121,188 10/1978 Ragan ..... 338/174
4,205,296 5/1980 Frey, Jr. ..... 338/174 X
4,654,625 3/1987 Bentz et al. ..... 338/164

*Primary Examiner*—E. A. Goldberg
*Assistant Examiner*—M. M. Lateef
*Attorney, Agent, or Firm*—Guy W. Shoup; Paul J. Winters

[57] ABSTRACT

A quasifixed variable resistor includes a resistor substrate with a resistor mounted thereon, a stopper plate rotatably retained about an axis on the substrate, and a knob having a slider fixed to an end of the stopper plate, the slider, sliding on the resistor. In a flat portion located at a bottom end of a cylindrical section of the stopper plate, a screwdriver engaging section having an adjusting groove is folded and is integrally formed therein. A wing piece branched by the adjusting groove is tapered in a direction toward the flat portion and a tip end of the screwdriver can be engaged with an end portion of the wing piece for adjustment.

2 Claims, 3 Drawing Sheets

QUASIFIXED VARIABLE RESISTOR

BACKGROUND OF THE INVENTION

1. Field of the Invention

The present invention relates to a quasifixed variable resistor for which a fine adjustment can be effected by use of a screwdriver of an automatic adjuster from a rear surface of the resistor, for example, during or after an assemblage of an electric circuit.

2. Description of the Prior Art

Although the process for mounting circuit elements including a quasifixed variable resistor on a printed circuit board has already been automated, the adjustment of the resistance value has been recently implemented by use of an automated system. In this method, a screwdriver included in the automated system for the adjustment is linked to an adjusting section of a variable resistor and the adjustment is achieved by rotating the screwdriver while checking the resistance value or the circuit constant.

Moreover, conventionally, the automatic adjustment is accomplished through an adjusting section disposed in the front surface (from the side of the front surface, the variable resistor is visible when the variable resistor is mounted on the printed circuit board) of the variable resistor. It has been recently required, however, to use an adjusting section disposed in a rear surface (from the side of the rear surface, the variable resistor is invisible when the variable resistor is mounted on the printed circuit board because it is interrupted by the printed circuit board) of the variable resistor, namely, a screwdriver is inserted through a hole formed in the printed circuit board and is linked to the adjusting section; thereafter, the automatic adjustment is effected.

FIGS. 4 and 5 are cross-sectional views of a conventinal quasifixed variable resistor for which the adjustment can be achieved through the rear surface.

The first conventional example of FIG. 4 includes a frame 21 made of, for example, a mold, a resistor substrate 22, a terminal 23 connected to both ends of a resistor, an intermediate terminal 24, and a knob 25 having an adjusting groove 26 on a surface thereof. The configuration further comprises a slider 27 fixed to the knob 25 and an adjusting rod 28 rotatably retained in the frame 21, the rod 28 having an end fixed to the slider 27 and the knob 25. Reference numeral 29 indicates an adjusting groove disposed in another end of the rod 28. A screwdriver (not shown) of the automatic adjuster is inserted into the groove 29 through the rear surface of the printed circuit board 30 shown by use of a double-dot-and-dash line and is rotated to achieve the adjustment.

In addition, as shown in the second conventional example of FIG. 5, there has been a type in which an end of the screwdriver is inserted into a hollow cylinder section 32 of a stopper plate 31 and then the screwdriver is further inserted into a hole 34 disposed in a knob 33; thereafter, the adjustment is achieved.

According to the first conventional example since described above, since the outer shape of the driving device of the automatic adjuster is usually rounded, the engagement thereof with the groove 29 having a small depth is difficult and the adjustment is impossible; consequently, there arises a disadvantage that the thickness of the adjusting section is increased if a groove 29 with a larger depth is used.

In the second conventional example, since the cylinder 32 of the stopper plate 31 has a small diameter and the hole 34 through which the screwdriver is inserted is also quite small, it may be possible that the hole 34 is damaged, which may also disable the adjustment. Furthermore, the screwdriver must be inserted into a deeper location and a great amount of travel must be made by the screwdriver of the adjuster; consequently, the structure of the adjuster becomes complicated and a long ajusting time is necessary for effecting a difficult adjusting operation.

In addition, for the type of the adjustment using a standard or slotted screwdriver as in the examples above, the period of time required when the tip end of the screwdriver is engaged with the adjusting section is twice that required for the type of the adjustment using a Phillips screwdriver; consequently, it may be considered to modify the adjusting section of these examples to a type of the adjustment using a Phillips-head screwdriver. In this case, however, for the type of the first conventional example, the thickness of the adjusting section is increased, whereas for the type of the second conventional example, it is difficult to modify the adjusting section itself to be of the type of the adjustment using a Phillips screwdriver.

SUMMARY OF THE INVENTION

It is therefore an object of the present invention to provide a quasifixed variable resistor of which the adjusting section has a small thickness and for which the adjustment is easy, thereby removing the disadvantages of the prior art.

In order to achieve the object above, according to the present invention, there is provided a quasifixed variable resistor comprising a resistor substrate with a resistor mounted thereon, a stopper plate rotatably retained about an axis on said substrate, and a knob including a slider fixed to an end of said stopper plate, said slider sliding on said resistor wherein in a flat portion located at a bottom end of a cylindrical section of said stopper plate, a screwdriver engaging section having an adjusting groove is bent and is integrally formed therein, and a wing piece branched by said adjusting groove is tapered in a direction toward the flat portion.

According to the present invention, since the tip end of the screwdriver is guided by means of a tapered wing piece, the engagement thereof with the adjusting groove becomes to be easy; furthermore, since the adjusting section is located at a position in the vicinity of the bottom end of the opening of the cylindrical section of the stopper plate, the operation conventionally required to push the tip end of the screwdriver deeply in the cylindrical section is not necessary. Consequently, the operation is facilitated. In addition, since the stopper plate is formed only by bending the ring in the flat portion, the dimension of a portion protruding downward from the bottom edge of the substrate can be minimized to the extent possible, which enables reducing the thickness of the variable resistor.

BRIEF DESCRIPTION OF THE DRAWINGS

The present invention will be apparent from the following detailed description taken in conjunction with the accompanying drawings in which.

DESCRIPTION OF THE PREFERRED EMBODIMENT

Referring now to the accompanying drawings, an embodiment of the present invention will be described.

Figure 1:
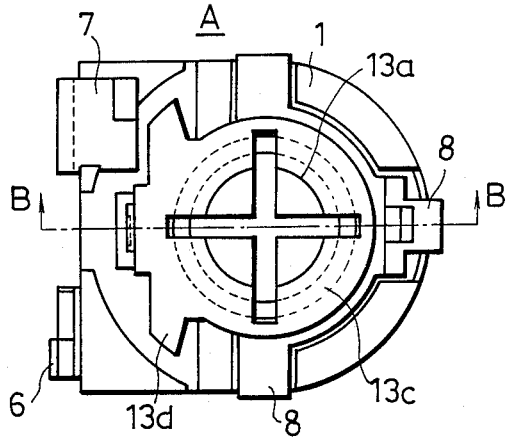
FIG. 1 is a rear view of an embodiment of the present invention.
Figure 2:
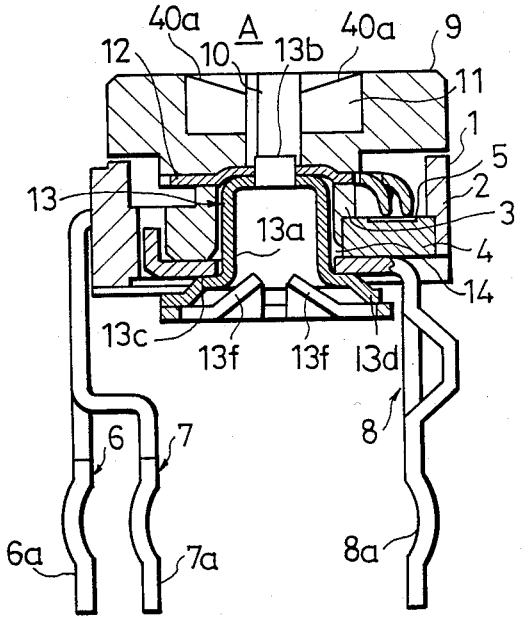
FIG. 2 is a cross-sectional view of the embodiment of FIG. 1 along the line B—B.
Figure 3:
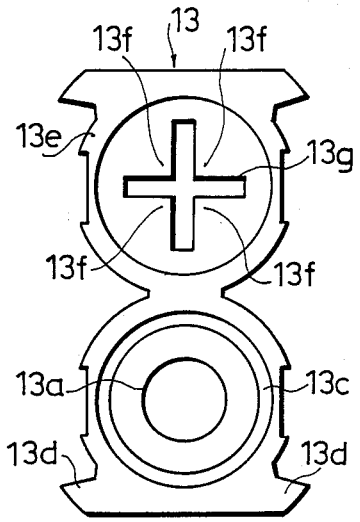
FIG. 3 is a developed diagram of a stopper plate.
Figure 4:
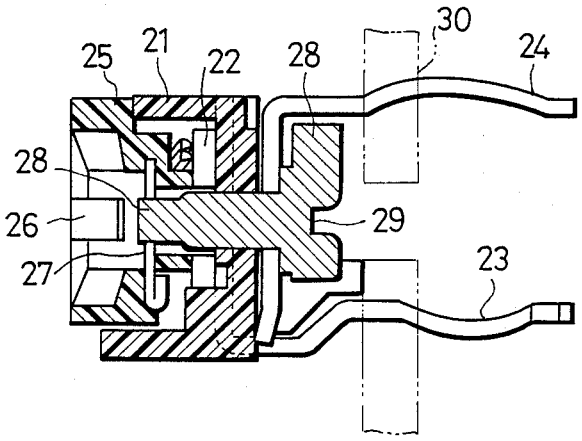
Fig. 4 PRIOR ART
FIGS. 4 and 5 are cross-sectional views of a first conventional example and a second conventional example, respectively of the prior art.
Figure 5:
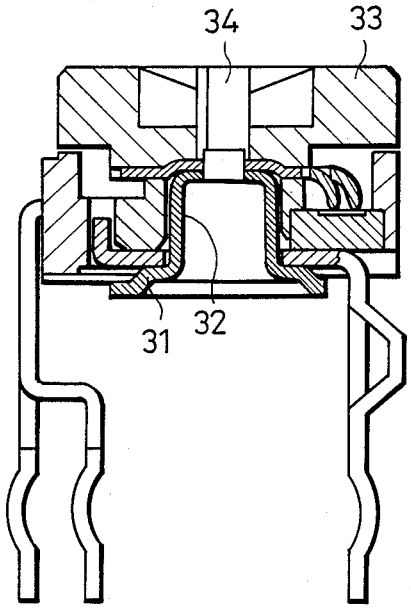
Fig. 5 PRIOR ART

FIG. 1 is a rear view of a quasifixed variable resistor, FIG. 2 is a cross-sectional diagram of the resistor of FIG. 1 along the line B—B, and FIG. 3 is a developed view of a stopper plate.

In FIGS. 1 and 2, the configuration includes a quasifixed variable resistor A, a frame 1 made of, for example, a mold, an outer wall 2, an inner wall 3, and a resistor substrate 4 disposed between the inner wall 3 and the outer wall 2. The configuration further includes a resistor 5 disposed on the substrate 4, terminals 6 and 7 respectively connected to the ends of the resistor 5, an intermediate terminal 8 attached to the bottom surface of the resistor substrate 4, and fixing legs 6*a*, 7*a*, and 8*a* used to fix the respective terminals 6, 7, and 8, extending downward from the bottom surface in the same direction. Reference numeral 9 is a knob having in a surface thereof a hole 10 and a groove 11 intersecting crosswise the hole 10. In the periphery of the hole 10 and the groove 11, there is formed a tapered surface 40*a* for guiding a screwdriver and the like. Reference numeral 12 is a slider fixedly secured on the knob 9 and reference numeral 13 indicates a stopper plate. A cylindrical section 13*a* thereof is loosely and rotatably engaged in a hole formed in the resistor substrate 4 inside of the inner wall 3, a fixing leg 13*b* thereof is bent to be engaged with an outer edge of the elliptic hole 10 in the knob 9, and a flat portion 13*c* having a shape of a sword guard has a sliding contact with the intermediate terminal 8.

Moreover, in a portion of an outside section of the flat portion 13*c*, there is provided a stopper section 13*d* to restrict the rotation angle of the intermediate terminal 8 and the stopper plate 13.

Incidentally, as shown in FIG. 3, the stopper plate 13 has an outer edge section having a shape substantially identical to the shape of a bottom edge including the stopper section 13*d* in a peripheral section of the flat portion 13*c*. A ring 13*e* having in the central portion thereof an adjusting groove 13*g* with a shape of a cross is integrally formed with the bottom edge of the stopper 13 in the developed state. The ring 13*e* is bent by 180° so as to align the outer edge section with the bottom edge; furthermore, a tapered portion is formed so that four wing pieces 13*f* . . . branched by the groove 13*g* approach the flat portion 13*c*.

FIG. 2 shows the ring 13*e* in the bent state in which the wing pieces 13*f* are inclined inwardly in a direction in which the screwdriver is fed; consequently, the tip end of the screwdriver is guided by and slides on the inclined surface. The tip end having a form of a plus sign is thereby engaged with the groove 13*g*. When the screw driver is rotated in this situation, the tip end of the screwdriver is linked to an edge of the wing piece 13*f*, the stopper plate 13 smoothly rotates, the slider 12 slides the resistor, and the resistance value is thereby adjusted.

According to the embodiment of the present invention, since the tip end of the Phillips screwdriver is guided by the tapered wing pieces 13*f*, the engagement thereof with the groove 13*g* is facilitated; furthermore, the adjusting section is located in the neighborhood of the bottom end of the cylinder section 13*a* of the stopper plate 13, which makes unnecessary the operation conventionally required to push the tip end of the screwdriver deeply into the cylinder section 13*a*. Consequently, when compared with the prior art, the adjustment becomes easy.

In addition, since the stopper plate 13 is obtained only by bending the ring 13*e* to align with the flat portion 13*c*, the dimension of a portion protruding downward from the bottom edge of the substrate 4 can be minimized.

Incidentally, although in the embodiment above, the ring 13*e* is provided with the groove 13*g* with a shape of a cross to match with the Phillips, if a standard screwdriver is to be used for the adjustment, the ring 13*e* need only be provided with a groove 13*g* having a shape of a minus sign.

According to the present invention, a ring integrally formed with a stopper plate having a cylinder section is folded over the bottom edge of an opening of the stopper plate, the ring is provided with an adjusting groove, and the wing pieces branched by the groove are tapered toward the inner circle of the opening; consequently, the adjusting screwdriver can be easily inserted and the operation to insert the screwdriver deeply in the cylinder section is makes unnecessary. As a consequence, the adjustment of the resistance value is facilitated.

In addition, since the stopper plate is formed by bending the ring to overlap the flat portion, the dimension of a portion protruding downward from the bottom edge of the substrate 4 can be minimized to the extent possible, which enables reducing the dimension of the thickness of the variable resistor.

While the present invention has been described with reference to the particular illustrative embodiment, it is not restricted by the embodiment but only by the appended claims. It is to be appreciated that those skilled in the card can change and modify the embodiment without departing from the scope and spirit of the invention.

What is claimed is:

1. A quasifixed variable resistor comprising:

a resistor substrate with a resistor mounted thereon;

a stopper plate rotatably retained about an axis on said substrate; and a knob including a slider fixed to an end of said stopper plate, said slider sliding on said resistor wherein in a flat portion located at a bottom end of a cylindrical section of said stopper plate, a screwdriver engaging section having an adjusting groove is folded and is integrally formed therein, a wing piece branched by said adjusting groove is tapered in a direction toward the flat portion, a tip end of said screwdriver is enabled to be engaged with an end portion of said wing piece for adjustment, said stopper plate includes two rings each substantially having a shape of a circle, a cylindrical section is formed in one of said two rings, said cylindrical section being engaged with a slider, a groove to be used to adjust a resistance value with a screwdriver is formed in the other one of said two rings, and said two rings are folded and rotatably fixed about an axis on said resistor substrate.

2. A quasifixed variable resistor according to claim 1 wherein a protrusion for a stopper is formed in a direction opposing to said two rings of said stopper plate.

* * * * *